US008932698B2

(12) United States Patent
Sterling et al.

(10) Patent No.: US 8,932,698 B2
(45) Date of Patent: Jan. 13, 2015

(54) PERFORATED WALLPAPER SYSTEM FOR USE IN A LOCKER

(75) Inventors: Christi Sterling, Plano, TX (US); JoAnn Brewer, Plano, TX (US)

(73) Assignee: Lamrite West, Inc., Strongsville, OH (US)

( * ) Notice: Subject to any disclaimer, the term of this patent is extended or adjusted under 35 U.S.C. 154(b) by 419 days.

(21) Appl. No.: 13/251,837

(22) Filed: Oct. 3, 2011

(65) Prior Publication Data

US 2012/0082819 A1 Apr. 5, 2012

Related U.S. Application Data

(60) Provisional application No. 61/404,363, filed on Oct. 1, 2010.

(51) Int. Cl.

| | |
|---|---|
| ***B65D 65/28*** | (2006.01) |
| ***A47B 96/20*** | (2006.01) |
| ***G09F 23/00*** | (2006.01) |
| ***G09F 7/04*** | (2006.01) |
| ***B44C 5/04*** | (2006.01) |

(52) U.S. Cl.

CPC ..... *A47B 96/20* (2013.01); *G09F 23/00* (2013.01); *G09F 7/04* (2013.01); *B44C 5/0461* (2013.01); *A47B 2096/209* (2013.01)

USPC ..... 428/99; 428/98

(58) Field of Classification Search

USPC ..... 428/99, 98

See application file for complete search history.

(56) References Cited

U.S. PATENT DOCUMENTS

2008/0263915 A1* 10/2008 Wardell ..... 40/1

* cited by examiner

*Primary Examiner* — Brent O'Hern

(74) *Attorney, Agent, or Firm* — Greenberg Traurig, LLP

(57) ABSTRACT

An apparatus and system for locker wallpaper panels include perforations and features for adapting the panels to selected locker configurations. The system includes magnets that are configured to affix the wallpaper panels to corresponding surfaces of the locker.

6 Claims, 6 Drawing Sheets

PERFORATED WALLPAPER SYSTEM FOR USE IN A LOCKER

CROSS-REFERENCE TO RELATED APPLICATION

This application claims priority under 35 USC 119(e) to U.S. provisional Application Ser. No. 61/404,363, filed on Oct. 1, 2010, and which is incorporated herein by reference.

TECHNICAL FIELD

This disclosure relates generally to decoration for lockers. More specifically, this disclosure relates to perforated wallpaper for use decorating in lockers.

BACKGROUND

Lockers are often provided in schools, hospitals, gyms, factories, ski lodges, and other institutions for users to store books, belongings and other materials. The lockers are typically identical from locker to locker. Users often desire to decorate or otherwise personalize their lockers.

SUMMARY

This disclosure provides a system, apparatus and method for wallpaper for use in lockers.

A wallpaper panel for use in a locker is provided. The wallpaper panel includes a decoration on a first face of the wallpaper panel, and a plurality of perforations configured to allow removal of a portion of the wallpaper panel to accommodate a fixture on a surface of the locker.

A system is also provided. The system includes a plurality of magnets, at least some of the magnets including covers. The system also includes a plurality of wallpaper panels. At least one wallpaper panel includes a decoration on a first face of the wallpaper panel, a plurality of perforations configured to allow removal of a portion of the wallpaper panel to accommodate a fixture on a surface of the locker. An appearance characteristic of at least one of the covers is based on the decoration of at least one of the wallpaper panels.

In one embodiment, magnets are configured to affix the wallpaper panels to corresponding surfaces of the locker.

Other technical features may be readily apparent to one skilled in the art from the following figures, descriptions, and claims.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

The various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1:
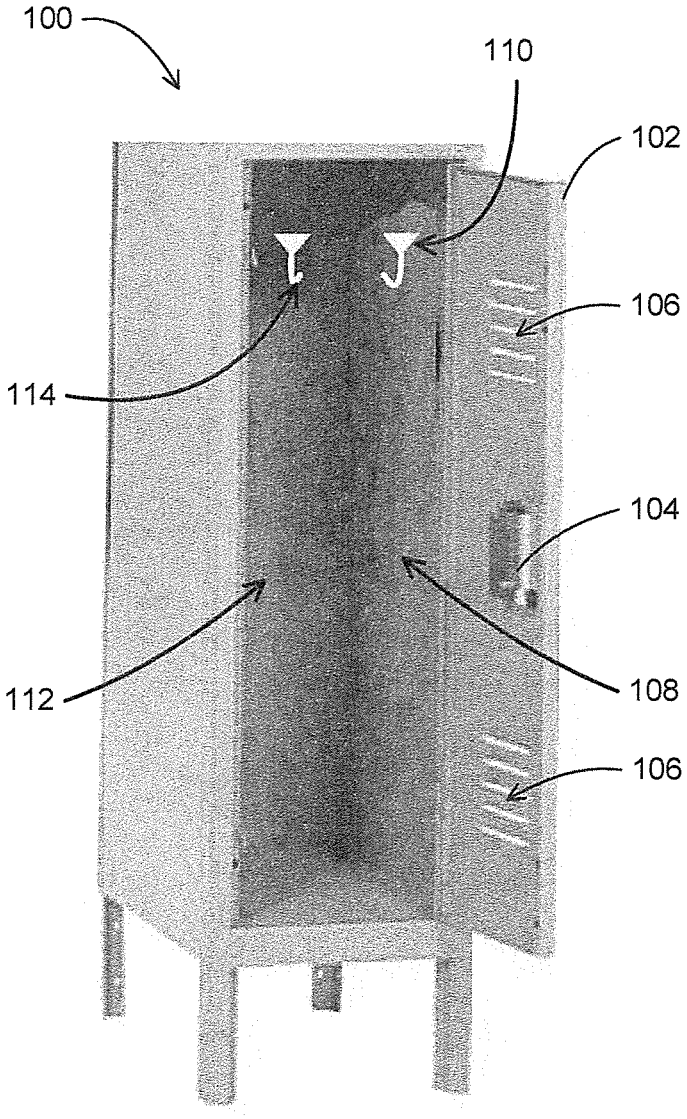
FIG. 1 depicts a locker of the type typically provided in a school, hospital, gym, factory, or other institution.

FIG. 1 depicts a locker 100 of the type typically provided in a school, hospital, gym, factory, or other institution. Two lockers of the type shown in FIG. 1 may be stacked one above the other. The locker 100 includes a door 102. The door 102 includes a latch mechanism 104 and louvers 106. The locker further includes two side panels 108 (the interior of one side panel is not visible in FIG. 1) and a back panel 112. One or both of the side panels 108 include a hook 110. The back panel 112 includes a hook 114.

While the lockers in an institution are typically identical among themselves, lockers purchased from different manufacturers or different locker product lines from a single manufacturer may be different from each other. Such differences may include the dimensions of a locker, as well as the number, size, location, and/or shape of interior fixtures such as latch mechanisms, hooks, and louvers. Furthermore, a locker manufacturer may provide alternative or additional interior fixtures.

Figure 2C:
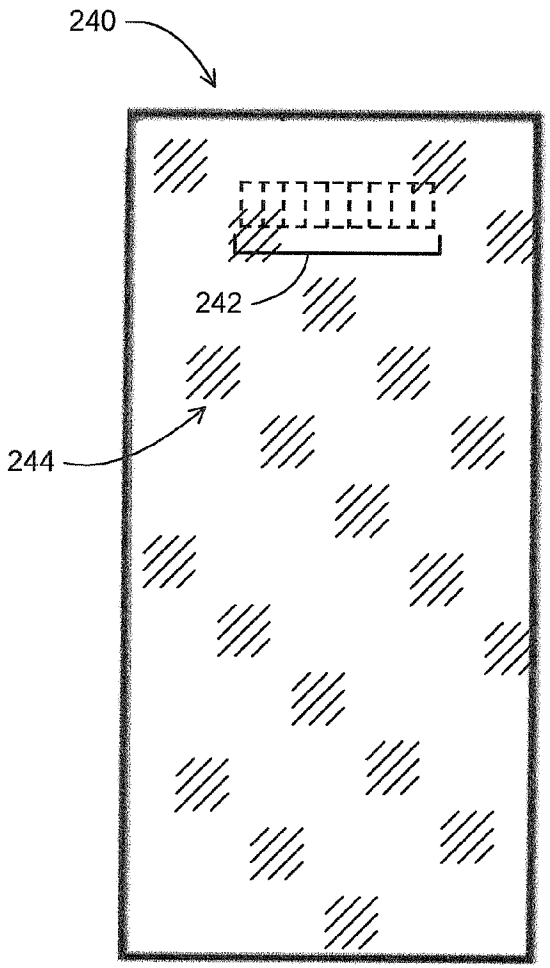
FIGS. 2A through 2C illustrate panels of locker wallpaper according to this disclosure.
Figure 2B:
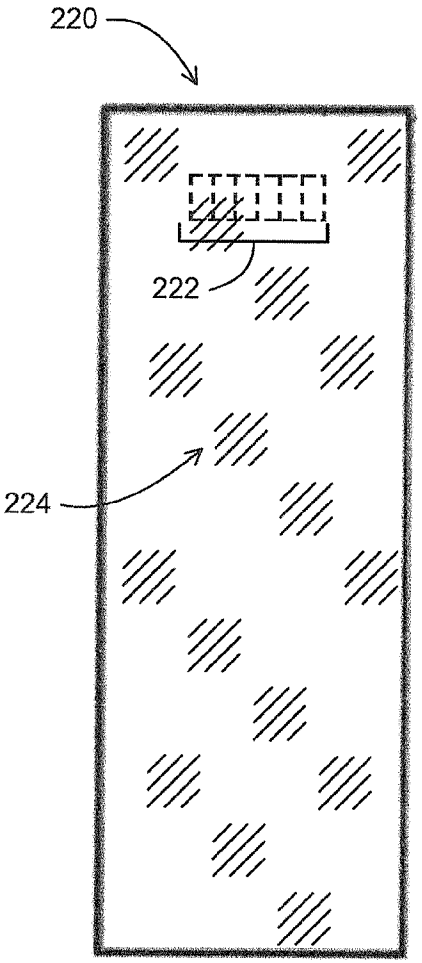
Figure 2A:
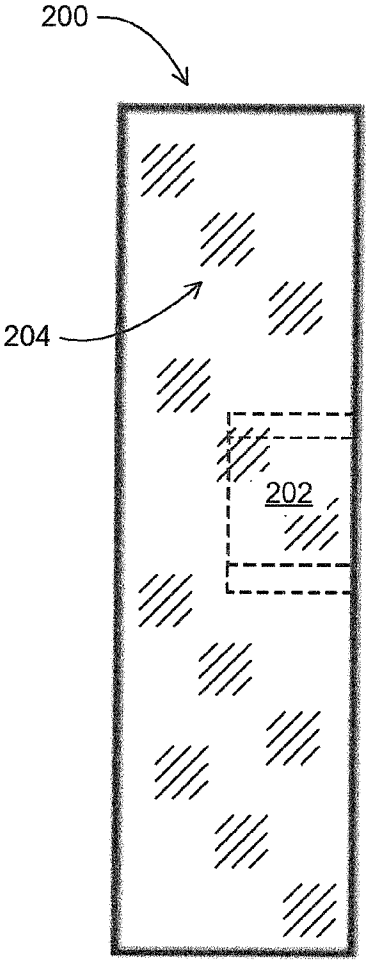

FIGS. 2A through 2C illustrate panels of locker wallpaper according to this disclosure. In FIG. 2A, a first wallpaper panel 200 includes a portion 202 outlined by perforations. Some or all of the portion 202 may be removed to leave an opening for the latch mechanism 104, allowing the remainder of the panel 200 to lie flat against the inside surface of the locker door 102. The perforations permit the removal of a desired sub-portion of the portion 202 without requiring the use of a knife or other tool.

The panel 200 has dimensions selected to fit on the inside surface of a locker door. Typically, the size of the panel 200 is selected to fit the largest locker likely to be encountered by a user. As will be described in more detail with reference to FIGS. 3A-3C, 4A-4C and 5A-5C, the user may cut the panel 200 to fit into a smaller locker.

As seen on the left side of the portion 202, a boundary of the portion 202 may be formed by a single line of perforations. As seen on the top and bottom of the portion 202, boundaries may be formed by two or more lines of perforations. Such multiple lines of perforations allow the panel 200 to be adapted to locker doors of different manufacturers and/or product lines. A user may select the perforations that produce an opening having a suitable size and location for a configuration of a latch mechanism of the user's locker. The user may then "punch out" the selected portion(s) of the panel 200 to form the desired opening.

A decoration 204 may be printed or otherwise transferred onto the panel 200. The decoration 204 may be a pattern, design, drawing, picture, photograph, slogan, name, or other graphical device that a manufacturer of the panel 200 may select in order to appeal to purchasers of locker wallpaper according to the disclosure. The decoration 204 may be a texture, flocking, or other treatment of the surface of the panel 200.

In FIG. 2B, a second wallpaper panel 220 includes a portion 222 outlined by perforations. The panel 220 has dimensions selected to fit on the inside surface of a back panel of the largest locker likely to be encountered by a user. The portion 222 includes a plurality of rectangular sub-portions outlined by lines of perforations. One or more rectangular sub-portions of the portion 222 may be removed to produce an opening having a suitable size and location for a configuration of a hook or other fixture on a back panel of the user's locker.

A decoration 224 may appear on the wallpaper panel 220. The decoration 224 may be identical to the decoration 204 or may be selected to be complementary to the decoration 204.

In FIG. 2C, a third wallpaper panel 240 includes a portion 242 outlined by perforations. The panel 240 has dimensions selected to fit on the inside surface of a side panel of the largest locker likely to be encountered by a user. The portion 242 includes a plurality of rectangular sub-portions outlined by lines of perforations. One or more rectangular sub-portions of the portion 242 may be removed to produce an opening having a suitable size and location for a configuration of a hook or other fixture on a side panel of the user's locker.

A decoration 244 may appear on the wallpaper panel 240. The decoration 244 may be identical to the decorations 204 and 224 or may be selected to be complementary to one or both the decorations 204 and/or 224.

Typically, one panel 200, one panel 220 and two panels 240 are packaged together for sale. However, individual panels may be provided as replacements or to permit the user to "mix and match" the decorations 204, 224 and 244.

While the portions 222 and 242 are interior to the wallpaper panels 220 and 240, respectively, it will be understood that, in other embodiments, additional or alternative portions of a wallpaper panel according to the disclosure may be perforated to adapt the panel to additional or alternative fixtures on the back panel of a locker. Furthermore, in still other embodiments, some or all of the portions may extend all the way to one or more sides of the wallpaper panel. Similarly, in other embodiments, the portion 202 of the panel 200 may be interior to the panel 200 or have any other suitable arrangement relative to the edges of the panel 200.

While the portions 202, 222 and 242 of panels 200, 220 and 240, respectively, have been described as outlined by lines of perforations, it will be understood that in other embodiments, lines may be printed on either face of the panels 200, 220 and 240, rather than being perforated. In such embodiments, a user may remove a desired sub-portion by cutting the wallpaper on or near the printed lines using a knife, scissors, or other tool.

Figures 3A, 3B, 3C:
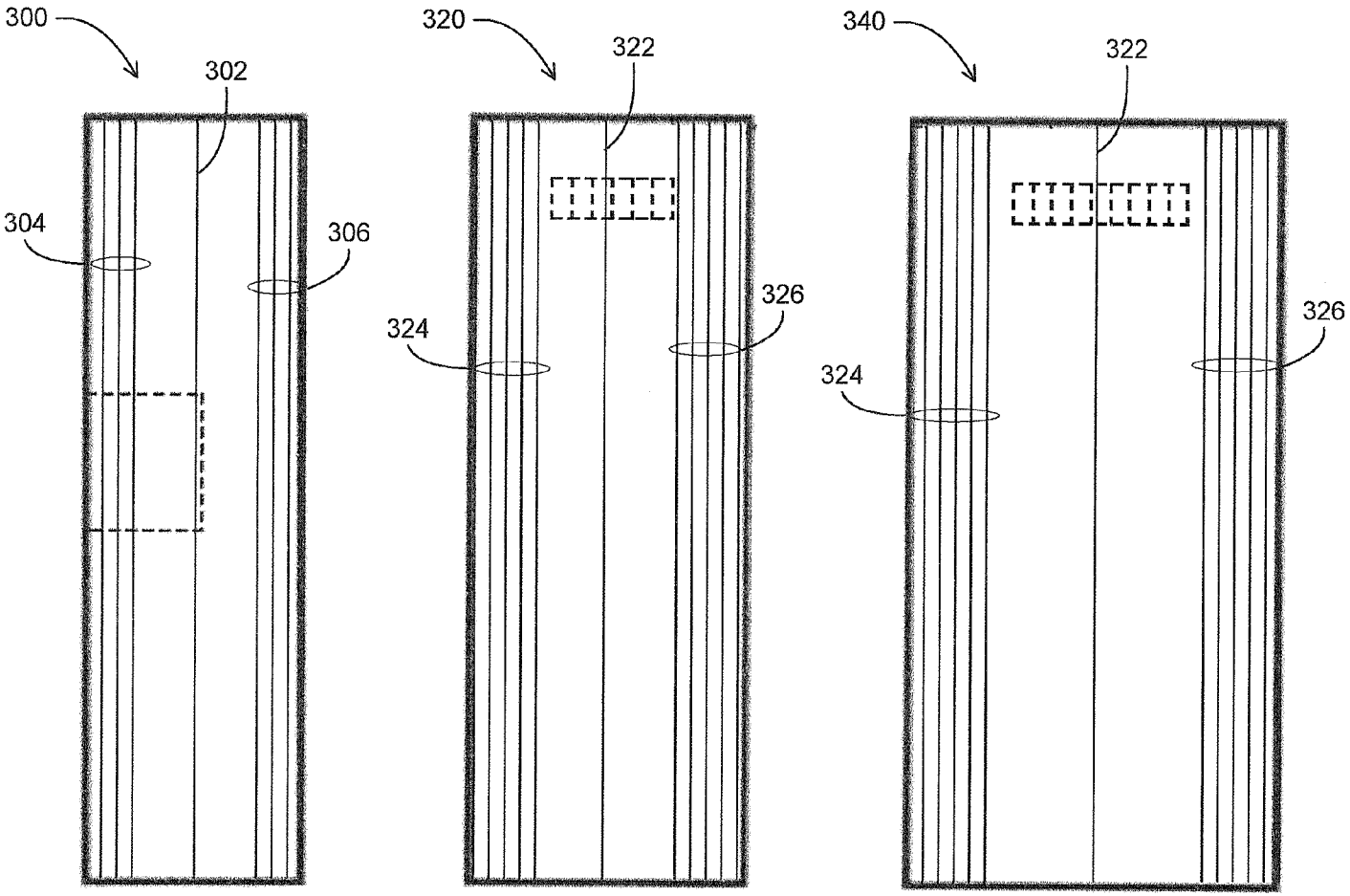
FIGS. 3A through 3C illustrate a first embodiment of reverse faces of the panels of FIGS. 2A through 2C according to this disclosure.

FIGS. 3A through 3C illustrate a first embodiment of reverse faces of the panels 200, 220 and 240 of FIGS. 2A through 2C according to the disclosure. In FIG. 3A a face 300 of the panel 200 opposite the face seen in FIG. 2A is presented. Guide lines 302, 304 and 306 are printed, scored, or otherwise transferred to the panel 200. The guide line 302 is located on a vertical centerline of the panel 200. The guide lines 304 and 306 are located symmetrically on opposite sides of the guide line 302. Where the panel 200 is too large for a user's locker, the guide lines 304 and 306 assist the user in cutting equal amounts from each side of the panel 200, so that a desired characteristic of the panel 200 is maintained after the cutting. For example, in this embodiment, the decoration 204 remains centered on the panel 200 after the cutting.

In FIG. 3B, a face 320 of the panel 220 opposite the side seen in FIG. 2B is presented. Guide lines 322, 324 and 326 are printed, scored, or otherwise transferred to the panel 220. The guide line 322 is located on a vertical centerline of the panel 220. The guide lines 324 and 326 are located symmetrically on opposite sides of the guide line 322 to assist the user in cutting equal amounts from each side of the panel 220, so that the decoration 224 remains centered on the panel 220 after cutting.

In FIG. 3C, a face 340 of the panel 240 opposite the side seen in FIG. 2C is presented. Guide lines 342, 344 and 346 are printed, scored, or otherwise transferred to the panel 240. The guide line 342 is located on a vertical centerline of the panel 240. The guide lines 344 and 346 are located symmetrically on opposite sides of the guide line 342 to assist the user in cutting equal amounts from each side of the panel 240, so that the decoration 244 remains centered on the panel 240 after cutting.

While the guide lines of FIGS. 3A-3C are features printed onto the faces 300, 320 and 340 of the panels 200, 220 and 240, in other embodiments, those guide lines may be features such as perforations, to enable the user to reduce the width of the panel without requiring the use of a knife, scissors, or other tool. In still other embodiments, the guide lines may be features that are scored into the faces 300, 320 and 340. Also, while only vertical guide lines are shown in FIGS. 3A-3C, in other embodiments horizontal guide lines may be included additionally or alternatively.

Figure 4C:
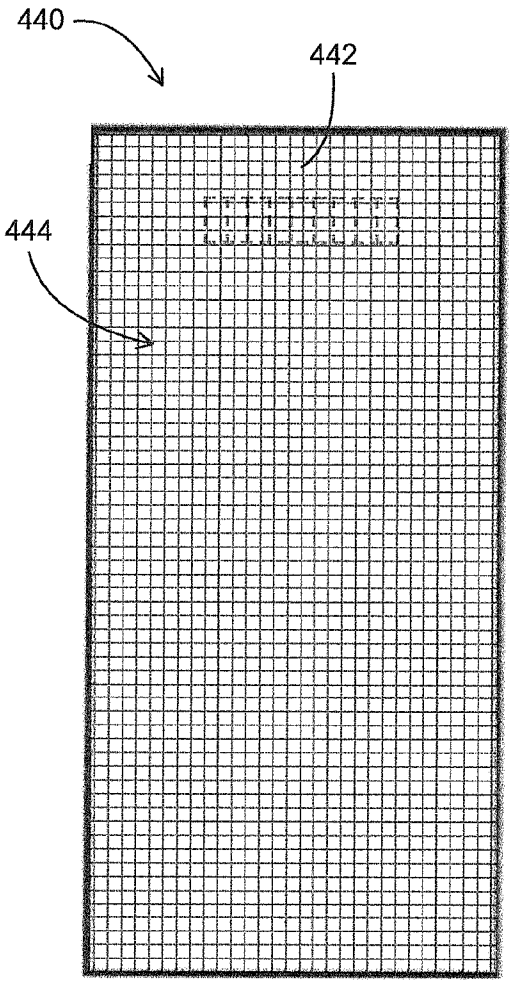
FIGS. 4A through 4C illustrate a second embodiment of reverse faces of the panels of FIGS. 2A through 2C according to this disclosure.
Figure 4B:
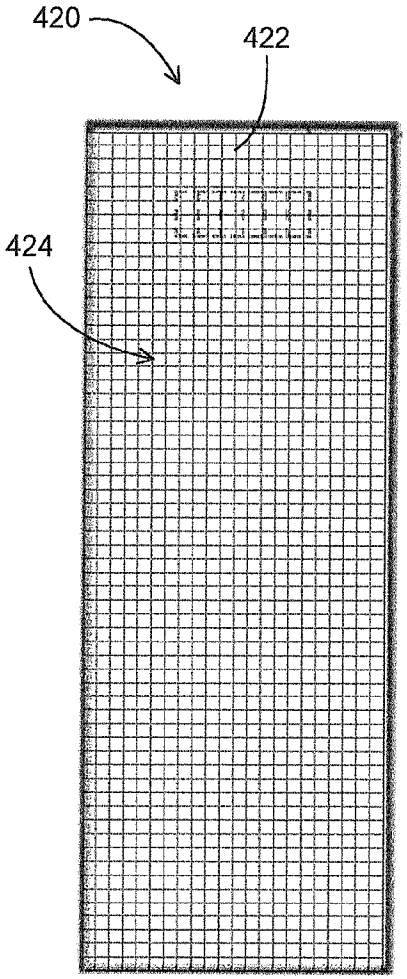
Figure 4A:
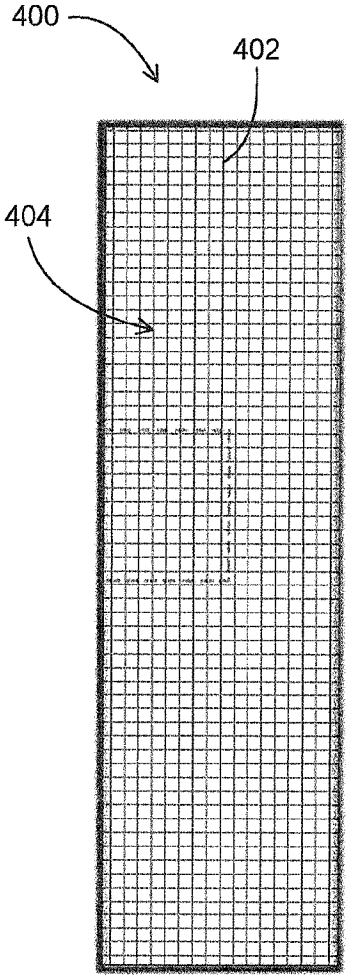

FIGS. 4A through 4C illustrate a second embodiment of reverse faces 400, 420 and 440 of the panels 200, 220 and 240, respectively, of FIGS. 2A through 2C according to the disclosure. Grids 404, 424 and 444 are printed on the faces 400, 420 and 440, respectively. Lines 402, 422 and 442 of the grids 404, 424 and 444, respectively, are located on vertical centerlines of the faces 400, 420 and 440. The vertical and horizontal lines of the grids 404, 424 and 444 assist a user in trimming the panels 200, 220 and 240 to a desired size, while maintaining a desired characteristic of the panel after the cutting. For example, in this embodiment, the lines assist a user in keeping the edges of the panel straight and parallel.

Figures 5A, 5B, 5C:
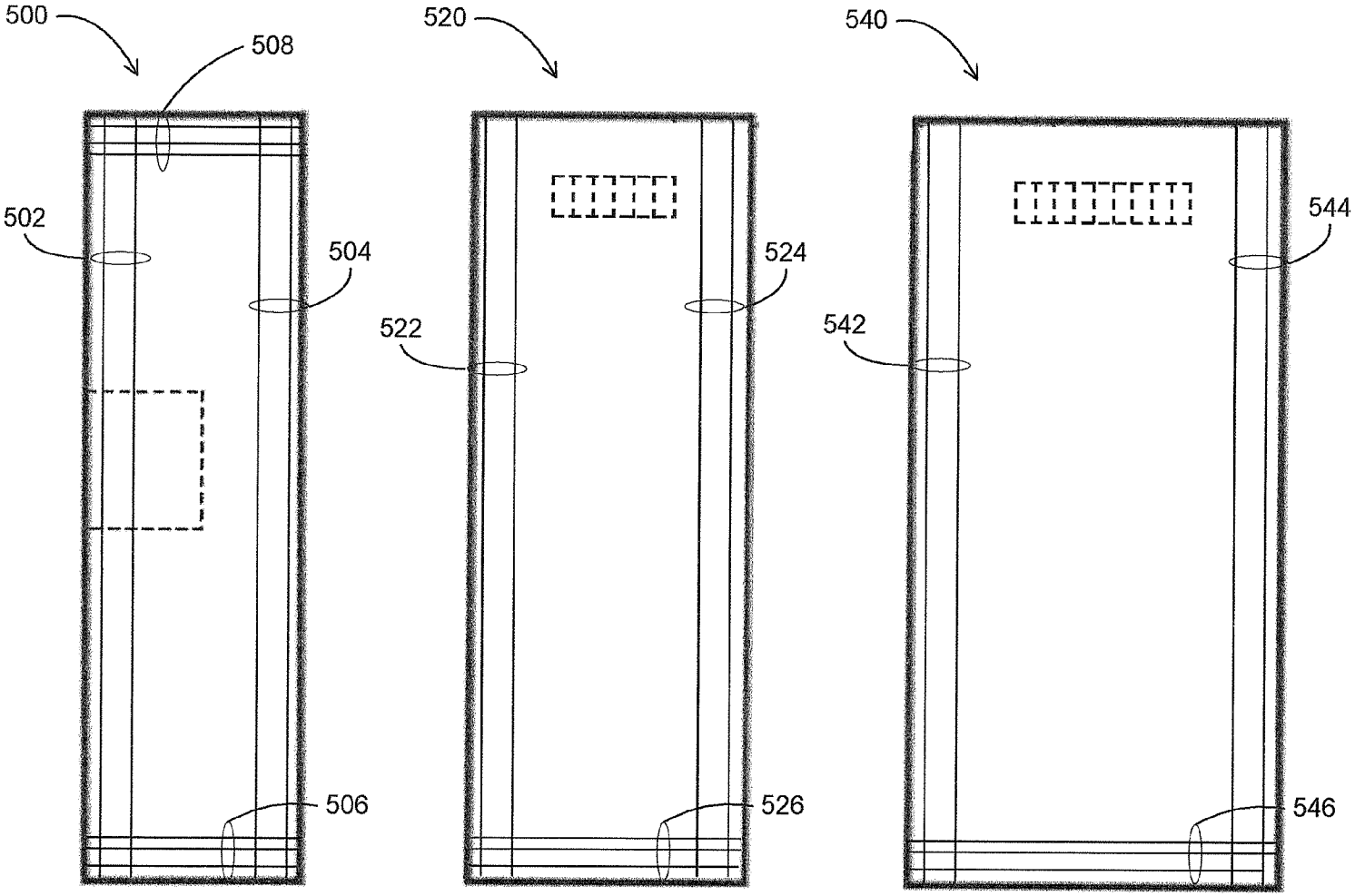
FIGS. 5A through 5C illustrate a third embodiment of reverse faces of the panels of FIGS. 2A through 2C according to this disclosure.

FIGS. 5A through 5C illustrate a third embodiment of reverse faces 500, 520 and 540 of the panels 200, 220 and 240, respectively, of FIGS. 2A through 2C according to the disclosure. In FIG. 5A, guide lines groups 502, 504, 506 and 508 are printed on the face 500. In combination, a guide line from each of the groups 502, 504, 506 and 508 outline the boundary of a door for a particular locker manufacturer or product line. The lines representing the outline of a first manufacturer's door may be printed with a first dot pattern. The lines representing the outline of a second manufacturer's door may be printed with a second dot pattern. In this way, a user will be able to trim the panel 200 to fit a configuration of the door of his/her locker without the need for a trial and error fitting process.

Similarly, the faces 520 and 540 include guide line groups 522/524/526 and 542/544/546, respectively. The guide lines of the faces 520 and 540 have dot patterns matching those of the face 500, corresponding to the outlines of back panels and side panels of the same locker manufacturers and/or product lines. A list of manufacturers and product lines may be provided along with panels having the reverse faces 500, 520 and 540 as a guide to the appropriate dot patterns for use in removing portions of the panels 200, 220 and/or 240 to adapt to a configuration of a surface of the user's particular locker.

While horizontal guide lines are shown only along the bottom edges of the faces 520 and 540, it will be understood that, in other embodiments, horizontal guide lines may additionally or alternatively be printed along the top edges of the faces 520 and 540. For the horizontal and vertical guide lines of FIGS. 5A-5C, individual lines may be placed nearer or farther from their respective edges so that, after trimming, the "punch out" portions of the resulting wallpaper panels are located appropriately for internal fixtures of the user's locker manufacturer or product line.

Figure 6:
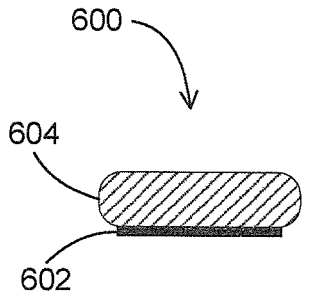
FIG. 6 illustrates a magnet 600 that may be used to hold the wallpaper panels to the inside surfaces of the user's locker, according to this disclosure.

FIG. 6 illustrates a magnet 600 that may be used to hold the wallpaper panels to the inside surfaces of the user's locker, according to this disclosure. A permanent magnet 602 is covered partially or completely by a cover 604. The cover 604 may have a color, shape, design, or other appearance characteristic that is selected based on one or more of the decorations 204, 224 and/or 244 of the panels 200, 220 and 240, respectively. For example, a color of the cover 604 may match or complement a color of one or more of the decorations 204, 224 and/or 244. Or, a shape of the cover 604 may be selected to match or complement a shape in one or more of the decorations 204, 224 and/or 244. As illustrated, because the permanent magnet 602 is opposite the cover 604 and the permanent magnet 602 is attached to the locker surface, when the magnet 600 is affixed to the surface of the locker, the decorative cover 604 of the magnet 600 and the decorations 204, 224 and/or 244 of the wallpaper panels are oriented in the same direction away from the surface of the locker.

A plurality of magnets 600 may be used to attach a panel to the locker. The style(s) of the covers 604 in the plurality of magnets 600 may be the same or may differ from some or all of the other covers 604. The plurality of magnets 600 may be packaged with some or all of the panels 200, 220 and 240, or may be provided separately, to allow the user to "mix and match" styles of the covers 604 with the decorations 204, 224 and/or 244 of the panels 200, 220 and 240.

Note that while the above description has described particular details of example wallpaper panels according to the disclosure, these details are for illustration only. Other techniques could be used to produce locker wallpaper panels according to the disclosure. In one example, the panel 220 may be combined with two of the panels 240 (one on each side) into a single panel that would cover both side walls and the back wall of the user's locker.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A locker decoration system, comprising:

a magnet comprising a decorative cover on a first face of the magnet, and a permanent magnet on an opposite face; and a plurality of wallpaper panels, at least one wallpaper panel comprising:

a decoration on a first face of the wallpaper panel;

a second face configured to lie against an inner surface of a locker; and a plurality of perforations configured to allow removal of a portion of the wallpaper panel to accommodate a fixture on a surface of the locker, wherein the permanent magnet of the magnet is contacted to the first face of the wallpaper panel to releasable affix the second face of the wallpaper panel to the surface of the locker, and wherein when affixed to the surface of the locker, the decorative cover of the magnet and the decoration of the wallpaper panel are oriented in the same direction away from the surface of the locker, and wherein the decorative cover of the magnet reproduces at least a portion of the decoration of the wallpaper panel.

2. The system of claim 1, the at least one wallpaper panel further comprising:

a feature on a second face of the wallpaper panel, the feature configured to guide removal of the portion of the wallpaper panel.

3. The system of claim 1, the at least one wallpaper panel further comprising:

a feature on a second face of the wallpaper panel, the feature configured to guide removal of a second portion of the wallpaper panel.

4. The system of claim 3, wherein the feature comprises a plurality of first parallel guide lines printed on the second face of the wallpaper panel.

5. The system of claim 4, wherein the feature further comprises a plurality of second parallel guide lines printed on the second face of the wallpaper panel, the second parallel guide lines being perpendicular to the first parallel guide lines.

6. The system of claim 1, wherein the fixture on the surface of the locker is at least one of a latch mechanism or a hook.

* * * * *